US010385659B2

(12) United States Patent
Chen

(10) Patent No.: US 10,385,659 B2
(45) Date of Patent: Aug. 20, 2019

(54) EVALUATION OF PRODUCTION PERFORMANCE FROM A HYDRAULICALLY FRACTURED WELL

(71) Applicant: Arizona Board of Regents on behalf of Arizona State University, Scottsdale, AZ (US)

(72) Inventor: Kangping Chen, Scottsdale, AZ (US)

(73) Assignee: Arizona Board of Regents on behalf of Arizona State University, Scottsdale, AZ (US)

( * ) Notice: Subject to any disclaimer, the term of this patent is extended or adjusted under 35 U.S.C. 154(b) by 153 days.

(21) Appl. No.: 15/378,286

(22) Filed: Dec. 14, 2016

(65) Prior Publication Data

US 2017/0175513 A1 Jun. 22, 2017

Related U.S. Application Data

(60) Provisional application No. 62/268,958, filed on Dec. 17, 2015.

(51) Int. Cl.
*E21B 47/00* (2012.01)
*G01B 21/20* (2006.01)
*E21B 43/00* (2006.01)

(52) U.S. Cl.
CPC ..... *E21B 43/00* (2013.01)

(58) Field of Classification Search
CPC ..... E21B 43/00
See application file for complete search history.

(56) References Cited

U.S. PATENT DOCUMENTS

| | | | | |
|---|---|---|---|---|
| 7,369,979 | B1 * | 5/2008 | Spivey | E21B 43/14 702/12 |
| 7,925,482 | B2 | 4/2011 | Kennon | |
| 8,412,500 | B2 | 4/2013 | Weng | |
| 8,838,427 | B2 | 9/2014 | Segal | |
| 9,790,770 | B2 * | 10/2017 | King | E21B 43/00 |
| 2002/0096324 | A1 * | 7/2002 | Poe, Jr. | E21B 43/00 166/250.15 |
| 2003/0050758 | A1 * | 3/2003 | Soliman | E21B 43/26 702/6 |

(Continued)

OTHER PUBLICATIONS

FMB, Flowing Material Balance (FMB) Analysis Theory, Dec. 11, 2015.*

(Continued)

*Primary Examiner* — Mohammad K Islam
(74) *Attorney, Agent, or Firm* — Snell & Wilmer L.L.P.

(57) ABSTRACT

An analytical solution is obtained for a pseudo-steady state production from a vertically fractured well with finite or infinite fracture conductivity. The analytical solution may be used to compute a pseudo-steady state constant for the reservoir. Subsequently, performance parameters relating to the reservoir may be derived from the pseudo-steady state constant. For example, parameters such as production decline rate, total hydrocarbon reserves, and economically recoverable reserves for the reservoir may be computed. The disclosed analytical solution, instead of a conventional numerical simulation, can significantly speed up analysis and improve the accuracy of the calculation of these parameters.

10 Claims, 4 Drawing Sheets

(56) References Cited

U.S. PATENT DOCUMENTS

| | | | | |
|---|---|---|---|---|
| 2003/0216898 | A1* | 11/2003 | Basquet | E21B 49/00 703/10 |
| 2003/0225522 | A1* | 12/2003 | Poe | E21B 43/00 702/11 |
| 2006/0276348 | A1* | 12/2006 | Cowan | C09K 8/34 507/224 |
| 2009/0198477 | A1* | 8/2009 | Benish | E21B 43/00 703/10 |
| 2009/0294122 | A1* | 12/2009 | Hansen | E21B 43/00 166/250.01 |
| 2010/0137169 | A1* | 6/2010 | Pope | C08F 8/00 507/205 |
| 2010/0138196 | A1* | 6/2010 | Hui | E21B 43/00 703/1 |
| 2010/0191516 | A1* | 7/2010 | Benish | E21B 43/00 703/10 |
| 2010/0286917 | A1* | 11/2010 | Hazlett | E21B 43/00 702/12 |
| 2011/0257944 | A1 | 10/2011 | Du | |
| 2012/0101787 | A1* | 4/2012 | Zhou | E21B 43/00 703/2 |
| 2012/0303342 | A1* | 11/2012 | Hazlett | E21B 43/00 703/2 |
| 2013/0116998 | A1* | 5/2013 | Shirzadi | E21B 43/20 703/10 |
| 2013/0332129 | A1 | 12/2013 | Xia | |
| 2014/0083687 | A1* | 3/2014 | Poe | E21B 43/26 166/250.1 |
| 2014/0136112 | A1* | 5/2014 | Al-Shawaf | E21B 47/00 702/6 |
| 2014/0341755 | A1* | 11/2014 | Laing | E21B 43/121 417/53 |
| 2015/0120255 | A1* | 4/2015 | King | E21B 43/00 703/2 |
| 2015/0211339 | A1* | 7/2015 | Khan | E21B 43/26 703/10 |
| 2017/0175513 | A1* | 6/2017 | Chen | E21B 43/00 |
| 2018/0202264 | A1* | 7/2018 | Sarduy | E21B 49/008 |

OTHER PUBLICATIONS

Amini et al., Evaluation of the Elliptical Flow Period for Hydraulically-Fractured Wells in Tight Gas Sands—Theoretical Aspects and Practical Considerations, 2007.*

Amini et al., Evaluation of the Elliptical Flow Period for Hydraulically-Fractured Wells in Tight Gas Sands—Theoretical Aspects and Practical Considerations (Year: 2007).*

FMB, Flowing Material Balance (FMB) Analysis Theory (Year: 2015).*

Agarwal, R.G., Carter, R.D. & Pollock, C.B., 1979. Evaluation and performance prediction of low-permeability gas wells stimulated by massive hydraulic fracturing, J. Pet. Technol., vol. 31(3), pp. 362-372.

Amini, S., Ilk, D., Blasingame, T. A., 2007, Evaluation of the Elliptical Flow Period for Hydraulically-Fractured Wells in Tight Gas Sands—Theoretical Aspects and Practical Considerations, Society of Petroleum Engineers, Paper 106308, pp. 1-13.

Atkinson, C., Eftaxiopoulos, D.A., 2002, Numerical and analytical solutions for the problem of hydraulic fracturing from a cased and cemented wellbore, International Journal of Solids and Structures, vol. 39., pp. 1621-1650, Elsevier.

Bickley, W.G., 1934. Two dimensional potential problems for the space outside a rectangle, Lond. Math. Soc. Proc., Ser. 2, 37, pp. 82-105.

Biryukov, D. & Kuchuk, F.J., 2012. Transient pressure behavior of reservoirs with discrete conductive faults and fractures, Transp. Porous Med., vol. 95, pp. 239-268.

Bourdet, D., 2002. Well Test Analysis: The Use of Advanced Interpretation Models, Elsevier.

Chen, K., Jin, Y., Chen, M., Pressure-Gradient Singularity and Production Enhancement for Hydraulically Fractured Wells, Geophysical Journal International, Aug. 2, 2013, vol. 195, pp. 923-931, Oxford University Press.

Cheng, Lee, McVay, 2009, A new approach for reliable estimation of hydraulic fracture properties using elliptical flow data in tight gas wells, SPE Reservoir Evaluation & Engineering, vol. 12, No. 2, pp. 254-262, Society of Petroleum Engineers.

Chin, W.C., 2002. Quantitative Methods in Reservoir Engineering, Gulf Professional Publishing, 2nd Edition, (Abstract Only).

Cinco-Ley, H. & Samaniego-V, F.F., 1981. Transient pressure analysis for fractured wells, J. Pet. Technol., vol. 33(9), pp. 1749-1766.

Cinco-Ley, H., Samaniego, V.F. & Dominguez, A.N., 1978. Transient pressure behavior for a well with a finite-conductivity vertical fracture, SPE J., vol. 18(4), pp. 253-264.

Clarkson CR., 2013, Production data analysis of unconventional gas wells: review of theory and best practices. Int J Coal Geol., vol. 109-110, pp. 101-146.

Craft, Hawkins, 1959, Applied Petroleum Reservoir Engineering, 3rd Ed., Prentice-Hall.

Earlougher, 1977, Advances in Well Test Analysis, Society of Petroleum Engineers of AIME.

Economides, Nolte, 2000, Reservoir Stimulation, 3rd Ed., Wiley.

Exadaktylos, G., 2012. A study of the transient fluid flow around a semi-infinite crack, Intl. J. Solids Struct., vol. 49(23-24), pp. 3323-3334.

Flax, L. & Simmons, J.H., 1966. Magnetic field outside perfect rectangular conductors. NASA Technical Note, TN-D3572.

Gringarten, A.C. & Ramsey, H.J. Jr., 1974. Unsteady pressure distribution created by a well with a single infinite-conductivity vertical fracture, SPE J., vol. 14, pp. 347-360.

Gringarten, A.C., Ramey, H.J. Jr. & Raghavan, R., 1975. Applied pressure analysis for fractured wells, J. Pet. Technol., vol. 27(7), pp. 887-892.

Jin, Y., Chen, K., Chen, M., Analytical Solution and Mechanisms of Fluid Production from Hydraulically Fractured Wells with Finite Fracture Conductivity, Journal of Engineering Mathematics, Jan. 31, 2014, vol. 92, No. 1, pp. 103-122, Springer.

Kamal M, Abbaszadeh M, Cinco-Ley H, Hegeman P, Horne R, Houze O, Kabir S, Kikani J, Kuchuk F, Landa J , Murray M, Ozkan E, Raghavan R, Samaniego F, Soliman M, 2009, Transient well testing. Society of Petroleum Engineers of AIME, Dallas.

Kikani, J., 1995, Flux determination of finite conductivity fractures using higher order interpolation functions, SPE Adv. Technol. Ser., vol. 3(1), pp. 76-84.

Kinkov, A.M., 2013, Analytical Solution of Hydraulic Fracture Problem for a Non-Newtonian Fluid, Journal of Mining Science, vol. 49, No. 1, pp. 8-18, Pleides Publishing, Ltd.

Kucuk, Brigham, 1979, Transient Flow in Elliptical Systems. Society of Petroleum Engineers Journal, vol. 19, No. 6, pp. 401-410.

Kuchuk, Brigham, 1981, Unsteady-state water influx in elliptic and anisotropic reservoir/aquifer systems. SPE J, vol. 21(3), pp. 309-314.

Lafe, O.E., Montes, J.S., Cheng, A.H-D., Liggett, J.A. & Liu, P.L-F., 1980. Singularities in Darcy flow through porous media, J. Hydrol. Div., Proc. ASCE, vol. 106, (HY6), pp. 977-997.

Lee, Brockenbrough, 1986, A new approximate analytic solution for finite-conductivity vertical fractures. SPE Form Eval, vol. 1(1), pp. 75-88.

Mathias, S.A. & van Reeuwijk, M., 2009. Hydraulic fracture propagation with 3-D leak-off, Transp. Porous Med., vol. 80(3), pp. 1573-1634.

Mathias, S.A., Tsang, C. & van Reeuwijk, M., 2010. Investigation of hydromechanical processes during cyclic extraction recovery testing of a deformable rock fracture, Intl. J. Rock Mech. Mining Sci., vol. 47(3), pp. 517-522.

Matthäi, Belayne, 2004, Fluid Flow Partitioning Between Fractures and a Permeable Rock Matrix, Geophysical Research Letters, vol. 31, American Geophysical Union.

Meyer B, Jacot R, 2005, Pseudosteady-state analysis of finite conductivity vertical fractures. SPE Paper 95941.

(56) References Cited

OTHER PUBLICATIONS

Moffat, H.K., 1964. Viscous and resistive eddies near a sharp corner, J. Fluid Mech., vol. 18, pp. 1-18.
Moffat, H.K. & Duffy, B.R., 1980. Local similarity solutions and their limitations, J. Fluid Mech., vol. 96, pp. 299-313.
Muskat, M., 1937. The Flow of Homogeneous Fluids Through porous Media, McGraw-Hill.
Nitsche, L.C. & Parthasarathi, P., 2012. Stokes flow singularity at the junction between impermeable and porous walls, J. Fluid Mech., vol. 713, pp. 183-215.
Obut, Ertekin, 1987, A Composite System Solution in Elliptic Flow Geometry, SPE Formation Evaluation, vol. 2, No. 3, pp. 227-238.
Ozkan E, 2012, Releasing shale gas potential with fractured horizontal wells, SPE Distinguished Lecture.
Pan, F. & Acrivos, A., 1967. Steady flows in rectangular cavities, J. Fluid Mech., vol. 28, pp. 643-655.
Phillips, Flow and Reactions in Permeable Rocks, 1991, Cambridge University Press, New York, (Abstract only).
Pouya, Ghabezloo, 2010, Flow Around a Crack in a Porous Matrix and Related Problems, Transport in Porous Media, vol. 84, pp. 511-532, Springer.
Pouya, Vu, 2012, Fluid Flow and effective permeability of an infinite matrix containing disc-shaped cracks, Advances in Water Resources, vol. 42, pp. 37-46, Elsevier.
Pouya, A., 2012. Three-dimensional flow in fractured porous media: a potential solution based on singular integral equations, Adv. Water Res., vol. 35, pp. 30-40.
Pratikno, H., Rushing, J., Blasingame, T.A., Decline Curve Analysis Using Type Curves—Fractured Wells, Society of Petroleum Engineers, 2003, 84287, pp. 1-14.
Prats, M., 1961. Effect of vertical fractures on reservoir behavior: incompressible fluid case, SPE J., vol. 1(2), pp. 105-118.
Prats, M., Hazebroek, P. & Strickler, W.R., 1962. Effect of vertical fractures on reservoir behavior-compressible fluids case, SPE J., vol. 2(2), pp. 87-94.
Raghavan, R., Cady, G.V. & Ramey, H.J. Jr., 1972. Well-test analysis for vertically fractured wells, J. Pet. Technol., 24(8), 1014-1020.
Raats, 2007, Uptake of water from soils by plant roots, Transport in Porous Media, vol. 68, No. 1, pp. 5-28, Springer.
Riley, M.F., 1991. Finite conductivity fractures in elliptical coordinates, PhD dissertation, Stanford University.
Roose, Schnepf, 2008, Mathematical models of plant-soil interaction, Philosophical Transaction of The Royal Society A, The Royal Society, vol. 366, pp. 4597-4611.
Valko, Economides, 1995, Hydraulic Fracture Mechanics, Wiley, Chichester, (Abstract Only).
Wilkinson, D.J., 1989, New results for pressure transient behavior of hydraulically-fractured wells, SPE Paper 18950. pp. 1-10, Society of Petroleum Engineers.

* cited by examiner

EVALUATION OF PRODUCTION PERFORMANCE FROM A HYDRAULICALLY FRACTURED WELL

CROSS-REFERENCE TO RELATED PATENT APPLICATIONS

This application claims the benefit of U.S. Provisional Patent Application No. 62/268,958 to Kangping Chen, filed on Dec. 17, 2015, and entitled "Evaluation Of Production Performance From A Hydraulically Fractured Well," which is hereby incorporated by reference in its entirety.

FIELD OF THE DISCLOSURE

The instant disclosure relates to extraction of underground resources. More specifically, this disclosure relates to determining performance factors relating to the extraction of underground resources from a particular well.

BACKGROUND

Production of hydrocarbon from a well is normally conducted with a constant production rate over long periods, although the rate can be changed during the productive life of the well due to maintenance and other technical requirements. FIG. 1 is a graph illustrating reservoir pressure change with time for a well producing at constant rate in a closed reservoir. $P_i$ is a reservoir initial pressure; $P_w$ is a wellbore pressure; and $P_{cri}$ is the lowest permissible wellbore pressure (critical pressure). The time sequence of the graph of FIG. 1 is $t_1<t_2<t_3<t_4<t_5<t_6$ . . . . At the start of a production, reservoir pressure initially depletes in the immediate neighborhood of the wellbore, and this pressure drawdown spreads outward diffusively towards the reservoir outer boundary (as shown in FIG. 1). For a closed (sealed) reservoir, the no-flow reservoir boundary starts to affect the pressure when the spreading pressure depletion front approaches the boundary. When the boundary effect has been fully reflected in the pressure field, the spatial distribution of the pressure no longer changes with time and the fluid flow reaches the so-called pseudo-steady state (lines 102A in FIG. 1). The flow prior to the pseudo-steady state flow is called the transient flow (lines 102B in FIG. 1), the duration of which depends on how fast the pressure drawdown diffuses in the reservoir, which in turn is determined by the reservoir and fluid properties, namely permeability, porosity, viscosity and compressibility. For conventional reservoirs where the permeability is greater than 0.1 mD (mini-Darcy), the transient flow period usually lasts from days to months; while for unconventional reservoirs which have permeabilities less than 0.1 mD, the period can last from years to even tens of years. For closed reservoirs, the pseudo-steady state flow is a dominant, long-duration and most productive flow regime, especially for conventional reservoirs. During the pseudo-steady state flow period, the wellbore bottom-hole flowing pressure (BHFP) decreases linearly in time in order to maintain the constant production rate. However, once the bottom-hole flowing pressure has declined to the lowest permissible value, which is often determined by the surface equipment limitations, a constant rate production can no longer be continued, and a constant pressure production must follow. The production rate for this constant pressure production period declines in time, eventually approaching zero as the reservoir pressure approaches the lowest permissible wellbore pressure (lines 102C in FIG. 1).

Pseudo-steady state flow is a dominant flow regime during constant rate production from a finite, closed reservoir. For a vertically fractured-well in a finite reservoir approximated as having an slightly elliptical shape, conventional solutions exist for analytically determining the flow for the case of infinite fracture conductivity. For finite fracture conductivity, conventional computational techniques to achieve a pseudo-steady state solution involve running numerical simulations over long times of hours, days, or longer.

Pseudo-steady state flow is a dominant flow regime during constant rate production from a closed reservoir: after the effects of the no-flow condition on the reservoir outer boundary have been fully reflected in the flow field and the transients associated with the flow startup have decayed to be negligible, the flow in the reservoir reaches a state in which the spatial distribution of the pressure no longer changes with time. Pseudo-steady state flow is thus a boundary-dominated flow. One definition for pseudo-steady state is the condition in a finite, closed reservoir when producing at a constant rate that "every point within the reservoir will eventually experience a constant rate of pressure decline." This constant rate of pressure decline is the result of mass conservation for constant rate production from a closed reservoir. This condition is sometimes referred to as pseudo-steady, quasi-steady, semi-steady, or even steady state. The term pseudo-steady is used here in reference to this particular flow regime.

Pseudo-steady state (PSS) can be a prolonged period of constant rate production from a closed reservoir. During this period, the reservoir pressure declines linearly with time, the rate of which is determined by the specified production rate and the drainage area. The pseudo-steady state solution provides the reservoir pressure distribution as well as the productivity index for this important flow period. Once the bottom hole flowing pressure has declined to the lowest permissible value, however, a constant rate production can no longer be continued, and a constant pressure production must follow. The production rate for this latter constant pressure production period declines in time. Production rate decline analysis for this period plays an important role for estimating the hydrocarbon reserves in place and for assessing the economically recoverable amount of fluid from a reservoir. Because pseudo-steady state is the flow regime immediate preceding the production rate decline period, the pseudo-steady state solution has been conventionally used in the production rate decline analysis for unfractured wells and for fractured wells. In these analyses, the pseudo-steady state dimensionless pressure drawdown at the wellbore is expressed as $$\Delta p_{wD,PSS}=2\pi t_{DA}+b_{D,PSS}, \tag{1}$$

where $t_{DA}$ is the drainage area based dimensionless time, and $b_{D,PSS}$ is the so-called pseudo-steady state constant which depends on the reservoir model as well as the well/reservoir configuration. This pseudo-steady state constant $b_{D,PSS}$ is used to define the appropriate dimensionless decline rate and time in many of the currently used production decline rate analysis models. Furthermore, the pseudo-steady state constant is the reciprocal of the dimensionless productivity index $J_{D,PSS}$ for the pseudo-steady state, $J_{D,PSS}=1/b_{D,PSS}$, which measures the productivity of the well for this flow period. $J_{D,PSS}$ is also important for production optimization for a fractured well. For unfractured wells, the pseudo-steady state constant $b_{D,PSS}$ can be obtained analytically for reservoirs of very simple shapes. These exact analytical solutions have been modified by shape factors and used as approximate analytical solutions for other reservoir geometries. For hydraulically fractured wells, however, exact analytical solution for $b_{D,PSS}$ is not available. For a vertically fractured well with infinite fracture conductivity, an exact analytical solution for the pseudo-steady state flow in a reservoir bounded by an elliptical boundary is known, which leads to an analytical expression for the pseudo-steady state constant $b_{D,PSS}$. For the more practical case of finite fracture conductivity, however, no exact analytical solution in the physical variable space has been reported in the literature for pseudo-steady state flow. For finite fracture conductivity, one conventional numerical procedure is to extract $b_{D,PSS}$ by subtracting $2\pi t_{DA}$ from the long-time numerical solution for constant rate production from a fractured well in an elliptical reservoir. This procedure is quite time consuming; and curve-fitting has been used to obtain an empirical relation between $b_{D,PSS}$ and the reservoir geometric parameter and the fracture conductivity.

SUMMARY

An analytical solution for pseudo-steady state flow for a vertically fractured well with finite fracture conductivity in a closed reservoir modeled as having a nearly circular, slightly elliptical shape is described in embodiments of the present invention. This analytical solution provides a solution to a problem with no previous known analytical solution. Furthermore, the analytical solution can be used in computer simulations to improve production performance of a hydraulically fractured well, provide prospectors with improved information for deciding on production wells, and improve production from those wells selected for production. The analytical solution allows computer modeling to be performed accurately and timely. Conventional techniques described above failed to provide an analytical solution for pseudo-steady state flow for vertically fractured wells, and those conventional techniques consumed significant amounts of computer processing time.

The analytical solution can be expressed in terms of elementary functions and provides a simple expression for the pseudo-steady state constant and the dimensionless productivity index. This analytical solution may be executed on a computer system to quickly generate performance parameters or other characteristics of the vertically fractured well. This solution eliminates the need of performing time-consuming numerical simulation for obtaining pseudo-steady state solution for fractured wells in a near circular reservoir and it may be used to generate approximate solutions for reservoirs of other geometrical shapes. For example, in comparison to the hours or days required of a computer to generate solutions according to the conventional techniques described above, a computer may generate solutions in accordance with described embodiments of the invention in a matter of seconds or minutes.

Described embodiments may yield a simple, exact expression for the pseudo-steady state constant $b_{D,PSS}$, which can be used for various applications including production rate decline analysis and fracture design for optimized production. The solution can also be used as a benchmark to measure the accuracy of numerical simulations. With suitable shape factors, the analytical solution may be used to obtain approximate expressions for the pseudo-steady state constant $b_{D,PSS}$ for fractured wells in reservoirs of other geometrical shapes.

According to one embodiment, a method may include receiving a plurality of shape factors corresponding to a geometrical shape of a hydraulically fractured well reservoir; determining a pseudo-steady state constant for the reservoir based, at least in part, on the plurality of shape factors; and/or determining a performance parameter of the reservoir when operated in a pseudo-steady state with a finite fracture conductivity based on the determined pseudo-steady state constant.

The foregoing has outlined rather broadly the features and technical advantages of the present invention in order that the detailed description of the invention that follows may be better understood. Additional features and advantages of the invention will be described hereinafter that form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features that are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the disclosed system and methods, reference is now made to the following descriptions taken in conjunction with the accompanying drawings.

DETAILED DESCRIPTION

Figure 2:
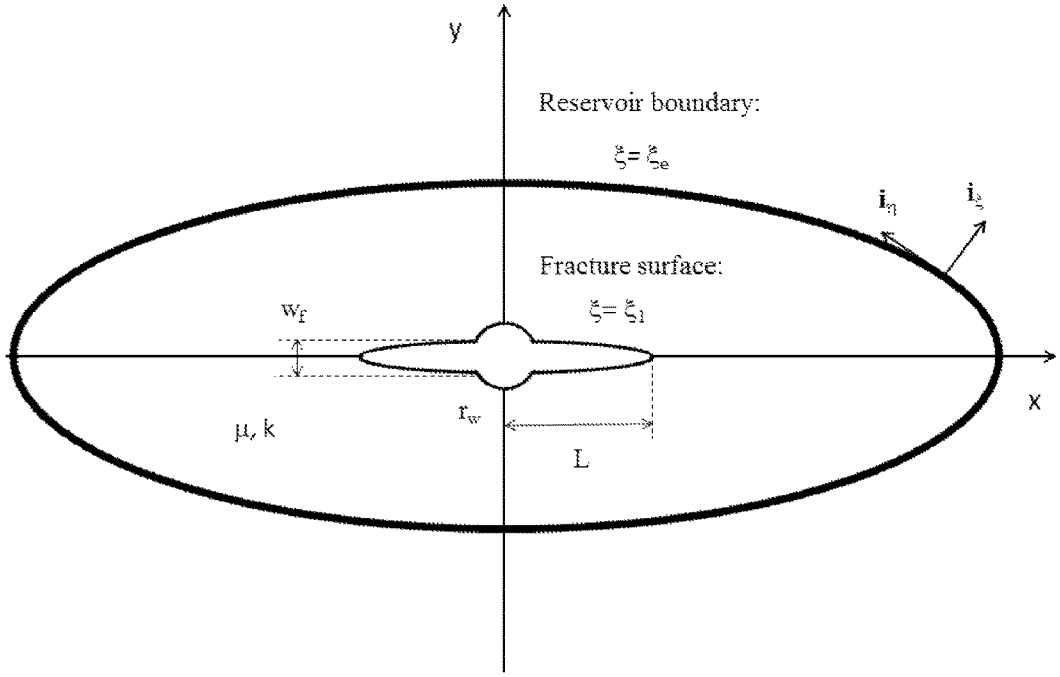
FIG. 2 is a top view of a vertical well intersected by a thin elliptical fracture according to some embodiments of the disclosure.

Consider fluid production from a fully-penetrated, vertically-fractured well from an initially quiescent state as shown in FIG. 2. FIG. 2 is a top view of a vertical well intersected by a thin elliptical fracture according to some embodiments of the disclosure. The drawing is for illustration purpose only and it does not reflect the actual scales. In some embodiments, the fracture may be very thin and long, $L \gg w_f$, and the fracture surface, $\xi=\xi_1\approx 0$. The following commonly used assumptions are made: the reservoir fluid is a single phase fluid residing in a homogeneous medium with its motion governed by the Darcy's law in both the reservoir and the fracture; the fluid and the reservoir are weakly compressible, characterized by a single lumped total compressibility constant $c_t$; the effects of wellbore storage and skin are negligible; and the hydraulic fracture is supported by propants and it is incompressible. The hydraulic fracture is modeled as a thin, long ellipse, intersecting the wellbore with a fracture width $w_f$, which is much smaller than the wellbore diameter $2r_w$. The Cartesian coordinates (x,y) and the elliptic coordinates (ξ,η) are related by $x=L\cos h\xi\cos\eta$, $y=L\sin h\xi\sin\eta$, with L being the focal distance which is essentially the fracture half-length; and $L>>w_f$. The surface of the narrow elliptical shape fracture is represented by the ellipse $\xi=\xi_1$ in the elliptic coordinates, and $\xi_1$ is a small number. Subscript "f" is used for reservoir and fracture quantities, respectively. The permeabilities in the reservoir and the hydraulic fracture are $\kappa,\kappa_f$, respectively, with $\kappa_f>>\kappa$. For a successful hydraulic fracturing job, the fluid production is nearly entirely from the fracture, and the contribution from the wellbore to the production is negligible. The reservoir has a finite extent and its outer boundary is an ellipse $\xi=\xi_e$, confocal with the limiting ellipse $\xi=\xi_1$ used to represent the fracture. For mathematical simplicity, the finite drainage area is assumed to have an elliptical shape, which is a good geometrical approximation to a large circular drainage area. A large circular reservoir with radius R can be well approximated as an elliptical reservoir with $\xi_e=\ln(2R/L)$.

For the convenience of discussing the physical aspects of the analytical solution, we formulate the problem in terms of pressure instead of pressure drawdown as in most of petroleum engineering literature. Pressure drawdown will be denoted as Δp throughout the paper. We choose the reservoir initial pressure $p_{i,d}$ and the pressure diffusion time scale as the characteristic pressure and characteristic time, respectively, for non-dimensionalization: $p_c=p_{i,d}, t_c=\mu\varphi c_t L^2/\kappa$, where μ,φ are the fluid viscosity and reservoir porosity, respectively. The dimensionless reservoir pressure satisfies a diffusion equation, which in an elliptical coordinates (ξ,η) becomes $$\frac{\partial^2 p_D}{\partial\xi^2}+\frac{\partial^2 p_D}{\partial\eta^2}=\frac{\cosh 2\xi-\cos 2\eta}{2}\frac{\partial p_D}{\partial t_{DL}}, \tag{2}$$

where the dimensionless time and the dimensionless pressure are defined by $$t_{DL}=\kappa t/(\mu\varphi c_t L^2), \tag{3}$$

$$p_D=p_d/p_{i,d}. \tag{4}$$

Initially the reservoir fluid is at rest. Symmetry condition applies on the x-axis and the y-axis; and the no-flow condition is imposed on the reservoir outer boundary, $$\xi=\xi_e:\frac{\partial p_D}{\partial\xi}=0. \tag{5}$$

When the fracture compressibility is neglected, the dimensionless pressure in the fracture, defined as $$p_{fD}(\eta,t_{DL})=p_{f,d}(\eta,t_{DL})/p_{i,d}, \tag{6}$$

satisfies the equation $$\frac{\partial^2 p_{fD}(\eta,t_{DL})}{\partial\eta^2}+\frac{2}{F_E}\frac{\partial p_D}{\partial\xi}\bigg|_{\xi=\xi_1}=0, \tag{7}$$

where the dimensionless elliptical fracture conductivity $$F_E=\frac{\kappa_f w_f}{\kappa L}. \tag{8}$$

This elliptical fracture conductivity $F_E$ is different from the rectangular fracture conductivity commonly denoted as $C_{fD}$. For an elliptical fracture, the width of the fracture is not a constant; $F_E$ and $C_{fD}$ only match with each other at the well. One way to relate $F_E$ and $C_{fD}$ is to assume that the elliptical fracture and the rectangular fracture have the same volume, which leads to $C_{fD}=\pi F_E/2$. Symmetry condition on the x-axis is imposed and a constant production rate at the wellbore is specified.

The Pseudo-Steady State Pressure Distribution in a Closed Elliptical Reservoir

A pseudo-steady-state (PSS) solution is the long-time asymptotic solution under constant production rate condition from a closed reservoir; and it has the property that $$\frac{\partial p_{D,PSS}}{\partial t_{DL}}=\text{const.}=-C<0, \tag{9}$$

where C is a dimensionless positive constant, C>0. Property (9) holds for any point in the reservoir. Thus, the reservoir pressure possesses the form $$p_{D,PSS}(\xi,\eta,t_{DL})=\tilde{p}(\xi,\eta)-Ct_{DL}, \tag{10}$$

and eqn. (2) becomes an eqn. for the shape function $\tilde{p}(\xi,\eta)$:

$$\frac{\partial^2\tilde{p}}{\partial\xi^2}+\frac{\partial^2\tilde{p}}{\partial\eta^2}=-C\frac{\cosh 2\xi-\cos 2\eta}{2}. \tag{11}$$

The solution to the inhomogeneous eqn. (11) can be written as $$\tilde{p}(\xi,\eta)=p_c(\xi,\eta)+p_p(\xi,\eta), \tag{12}$$

where $p_c(\xi,\eta)$ satisfies the homogeneous eqn.

$$\frac{\partial^2 p_c}{\partial\xi^2}+\frac{\partial^2 p_c}{\partial\eta^2}=0, \tag{13}$$

and $p_p(\xi,\eta)$ is a particular solution of the inhomogeneous eqn.

$$\frac{\partial^2 p_p}{\partial\xi^2}+\frac{\partial^2 p_p}{\partial\eta^2}=-C\frac{\cosh 2\xi-\cos 2\eta}{2}. \tag{14}$$

One solution to equation (14) is $$p_p(\xi,\eta)=-\frac{C}{8}(\cosh 2\xi+\cos 2\eta). \tag{15}$$

A possible solution to the homogeneous equation (13) has the form:

$$p_C(\xi,\eta)=B_0+A_0\xi-\sum_{n=1}^{\infty}A_n\cos 2n\eta\cosh 2n(\xi_e-\xi), \tag{16}$$

where $A_i$(i=0, 1, 2 . . . ) are constants, and the symmetry conditions on the x-axis and y-axis (η=0,π/2) have already been satisfied. The infinite series enters the fracture eqn. because of its non-zero flux density on the fracture surface. For the case of finite fracture conductivity, this infinite series is needed to match the non-constant fracture pressure inside the fracture.

Thus, the reservoir pressure for pseudo-steady state is given by $$p_{D,PSS}(\xi,\eta,t_{DL}) = B_0 + A_0\xi - \sum_{n=1}^{\infty} A_n\cos 2n\eta\cosh 2n(\xi_e-\xi) - \frac{C}{8}(\cosh 2\xi + \cos 2\eta) - Ct_{DL}. \tag{17}$$

The no-flow outer boundary condition of equation (5) requires that $$A_0 = \frac{C}{4}\sinh 2\xi_e > 0. \tag{18}$$

The complete pseudo-steady-state solution for the dimensionless pressure in the reservoir ($\xi_1 \le \xi \le \xi_e$) is then $$p_{D,PSS}(\xi,\eta,t_{DL}) = B_0 + \frac{C}{4}\xi\sinh 2\xi_e - \sum_{n=1}^{\infty} A_n\cos 2n\eta\cosh 2n(\xi_e-\xi) - \frac{C}{8}(\cosh 2\xi + \cos 2\eta) - Ct_{DL}. \tag{19}$$

The constant C is directly related to the fluid production rate. The dimensional flux-density $q_d(\eta)$ on the fracture surface $\xi=\xi_1$ for the fluid entering the fracture from the reservoir is given by $$\begin{aligned} q_d(\eta) &= \frac{\kappa}{\mu}\frac{p_{i,d}}{L\sqrt{\sinh^2\xi_1+\sin^2\eta}}\left.\frac{\partial p_D}{\partial \xi}\right|_{\xi=\xi_1} \\ &= \frac{\kappa}{\mu}\frac{p_{i,d}}{L\sqrt{\sinh^2\xi_1+\sin^2\eta}} \\ &\quad \left[\frac{C}{4}(\sinh 2\xi_e - \sinh 2\xi_1) + \sum_{n=1}^{\infty} 2nA_n\cos 2n\eta\sinh 2n(\xi_e-\xi_1)\right]. \end{aligned} \tag{20}$$

Therefore the dimensional production-rate for a bi-wing fractured-well is $$Q_d = 4h\int_0^{\pi/2} q_d(\eta)L\sqrt{\sinh^2\xi_1+\sin^2\eta}\,d\eta = \frac{\pi\kappa h p_{i,d}}{2\mu}C(\sinh 2\xi_e - \sinh 2\xi_1), \tag{21}$$

where h is the formation thickness. Thus, the dimensionless parameter C is related to the well production rate by $$C = \frac{2\mu}{\pi\kappa h p_{i,d}}\frac{Q_d}{\sinh 2\xi_e - \sinh 2\xi_1}. \tag{22}$$

The Pseudo-Steady State Pressure Profile in the Fracture

The fracture pressure of equation (7) can be written as $$\frac{\partial^2 p_{fD,PSS}(\eta,t_{DL})}{\partial\eta^2} + \frac{2}{F_E}\left[\frac{C}{4}(\sinh 2\xi_e - \sinh 2\xi_1) + \sum_{n=1}^{\infty} 2nA_n\cos 2n\eta\sinh 2n(\xi_e-\xi_1)\right] = 0. \tag{23}$$

There is no-flow across the x-axis due to symmetry, $$\eta=0:\ \partial p_{fD,PSS}/\partial\eta = 0, 0 \le \xi \le \xi_1. \tag{24}$$

The pseudo-steady state property also holds for the pressure inside the fracture, $$\frac{\partial p_{fD,PSS}(\eta,t_{DL})}{\partial t_{DL}} = -C. \tag{25}$$

Integration of equation (23) subject to equations (24) and (25) gives the dimensionless fracture pressure $$p_{fD,PSS}(\eta,t_{DL}) = -\frac{2}{F_E}\left[\frac{C}{8}(\sinh 2\xi_e - \sinh 2\xi_1)\eta^2 - \sum_{n=1}^{\infty}\frac{A_n}{2n}\cos 2n\eta\sinh 2n(\xi_e-\xi_1)\right] - Ct_{DL} + \tilde{C}, \tag{26}$$

where $\tilde{C}$ is an integration constant.

The dimensionless pressure at the well, which is unknown for the PSS solution, is given by $$p_{wD,PSS} = p_{fD,PSS}(\pi/2,t_{DL}) = -\frac{2}{F_E}\left[\frac{\pi^2 C}{32}(\sinh 2\xi_e - \sinh 2\xi_1) - \sum_{n=1}^{\infty}(-1)^n\frac{A_n}{2n}\sinh 2n(\xi_e-\xi_1)\right] - Ct_{DL} + \tilde{C}. \tag{27}$$

Determination of the Coefficients

The coefficients $A_n$ and the constant $\overline{C}$ in the solution for the pressure can be obtained by matching the reservoir pressure on the fracture surface with the fracture pressure and an application of the material balance equation. Because the fracture is narrow and $\xi_1$ is very small, we set $\xi_1 \approx 0$ in all calculations below.

Pressure Matching on the Fracture Surface

On the fracture surface, $\xi=\xi_1=0$, the reservoir pressure and the fracture pressure must match, $$p_{D,PSS}(0,\eta,t_{DL}) = p_{fD,PSS}(\eta,t_{DL}).$$

This leads to equation (28):

$$B_0 - \sum_{n=1}^{\infty} A_n\cos 2n\eta\cosh 2n\xi_e - \frac{C}{8}(1+\cos 2\eta) - Ct_{DL} = -\frac{2}{F_E}\left[\frac{C}{8}\eta^2\sinh 2\xi_e - \sum_{n=1}^{\infty}\frac{A_n}{2n}\cos 2n\eta\sinh 2n\xi_e\right] - Ct_{DL} + \tilde{C}. \tag{28}$$

It is observed that, without the infinite series in the reservoir pressure, it would not be possible to match the $\eta^2$ term from the fracture pressure. Pressure matching can be accomplished by simply expanding $\eta^2$ as a cosine series.

The Material Balance Equation

The dimensionless reservoir pressure drawdown $\Delta p_{mD}$ is defined as $$\Delta p_D = \frac{2\pi\kappa h}{\mu Q_d} = [p_{i,d} - p_d] = \frac{2\pi\kappa h p_{i,d}}{\mu Q_d}[1 - p_D]. \tag{29}$$

For a closed reservoir and constant rate production, the material balance equation provides a simple relation between the reservoir average pressure drawdown and time, $$\Delta\overline{p}_D = \frac{2\pi\kappa h}{\mu Q_d}[p_{i,d} - \overline{p}_d(t)] = 2\pi t_{DA}, \tag{30}$$

where $\overline{p}_d(t)$ is the reservoir volume-averaged pressure $$\overline{p}_d(t) = \frac{1}{V}\int_V p_d\, dv, \tag{31}$$

V being the reservoir volume; and $t_{DA}$ is the dimensionless time defined in terms of the draining area, $A=V/h=\pi L^2 \sinh 2\xi_e/2$, $$t_{DA} = \frac{\kappa t}{\mu c_t \phi A} = \frac{2}{\pi}\frac{t_{DL}}{\pi\sinh 2\xi_e}. \tag{32}$$

Computing the reservoir average pressure using the solution of equation (19) and utilizing the relation between the constant C and the production rate $Q_d$ of equation (22), the material balance equation (30) becomes, $$\int_A\left[1 - B_0 - \frac{C}{4}\xi\sinh 2\xi_e + \sum_{n=1}^{\infty} A_n\cos 2n\eta\cosh 2n(\xi_e - \xi) + \frac{C}{8}(\cosh 2\xi + \cos 2\eta)\right]dA = 0, \tag{33}$$

which leads to $$B_0 = 1 - \frac{C}{4}\left(\xi_e\sinh 2\xi_e - \frac{\cosh 2\xi_e - 1}{2}\right) + \frac{C}{16}\cosh 2\xi_e - \frac{A_1}{2}. \tag{34}$$

Matching Fourier coefficients in equation (28) then gives $$\tilde{C} = 1 - \frac{C}{4} - \frac{C}{4}\xi_e\sinh 2\xi_e + \frac{3C}{16}\cosh 2\xi_e - \frac{A_1}{2} + \frac{C}{F_E}\frac{\pi^2}{48}\sinh 2\xi_e, \tag{35}$$

$$A_1 = -\frac{C}{\cosh 2\xi_e + \frac{\sinh 2\xi_e}{F_E}}\left[\frac{1}{8} + \frac{1}{F_E}\frac{\sinh 2\xi_e}{4}\right], \tag{36}$$

$$A_n = \frac{C}{4}\frac{(-1)^n}{n}\frac{\sinh 2\xi_e}{\sinh 2n\xi_e + nF_E\cosh 2n\xi_e},\ n \geq 2. \tag{37}$$

Thus, the pressure in the reservoir and the fracture are completely determined. In particular, the dimensionless pressure drawdown in the reservoir is given by $$\Delta p_{D,PSS}(\xi, \eta, t_{DL}) = 2\pi t_{DA} + \xi_e - \xi + + \frac{1}{\sinh 2\xi_e}\left[-\frac{3\cosh 2\xi_e - 2}{4} + 2a_1 + 4a_1\cos 2\eta\cosh 2(\xi_e - \xi) + \frac{\cosh 2\xi + \cos 2\eta}{2}\right], + \sum_{n=2}^{\infty}\frac{(-1)^n}{n}\frac{\cos 2n\eta\cosh 2n(\xi_e - \xi)}{\sinh 2n\xi_e + nF_E\cosh 2n\xi_e} \tag{38}$$

where $$a_1 = \frac{A_1}{C} = -\frac{1}{8}\frac{1}{\cosh 2\xi_e + \frac{\sinh 2\xi_e}{F_E}}\left[1 + \frac{2}{F_E}\sinh 2\xi_e\right]. \tag{39}$$

Shank's transformation can be used to accelerate the convergence of the infinite series in equation (38).

The dimensionless pressure drawdown at the well is given by $$\Delta p_{wD,PSS} = 2\pi t_{DA} + \xi_e + \frac{1}{\sinh 2\xi_e} - \frac{3}{4}\coth 2\xi_e + \frac{2a_1}{\sinh 2\xi_e} + \frac{1}{F_E}\left[\frac{\pi^2}{6} + 4a_1 - \sum_{n=2}^{\infty}\frac{1}{n^2}\frac{1}{1 + nF_E\coth 2n\xi_e}\right]. \tag{40}$$

Thus, an explicit expression for the pseudo-steady state constant $b_{D,PSS}$ is given by $$b_{D,PSS} = \xi_e + \frac{1}{\sinh 2\xi_e} - \frac{3}{4}\coth 2\xi_e + \frac{2a_1}{\sinh 2\xi_e} + \frac{1}{F_E}\left[\frac{\pi^2}{6} + 4a_1 - \sum_{n=2}^{\infty}\frac{1}{n^2}\frac{1}{1 + nF_E\coth 2n\xi_e}\right]. \tag{41}$$

In addition, the productivity index (PI) and the dimensionless productivity index ($J_D$) for the pseudo-steady state flow is given by $$J_{PSS} = \frac{Q_d}{\overline{P}_d - P_{w,d}} = \frac{\kappa h}{\mu}\frac{2\pi}{b_{D,PSS}}, \quad J_{D,PSS} = \frac{\mu}{2\pi\kappa h}J_{PSS} = \frac{1}{b_{D,PSS}} \tag{42}$$

The dimensionless productivity index $J_D$, or the effective wellbore radius, can be used to characterize the productivity of unfractured and fractured wells. For example, $J_{D,PSS}$ can be used for fracture design.

Figure 3:
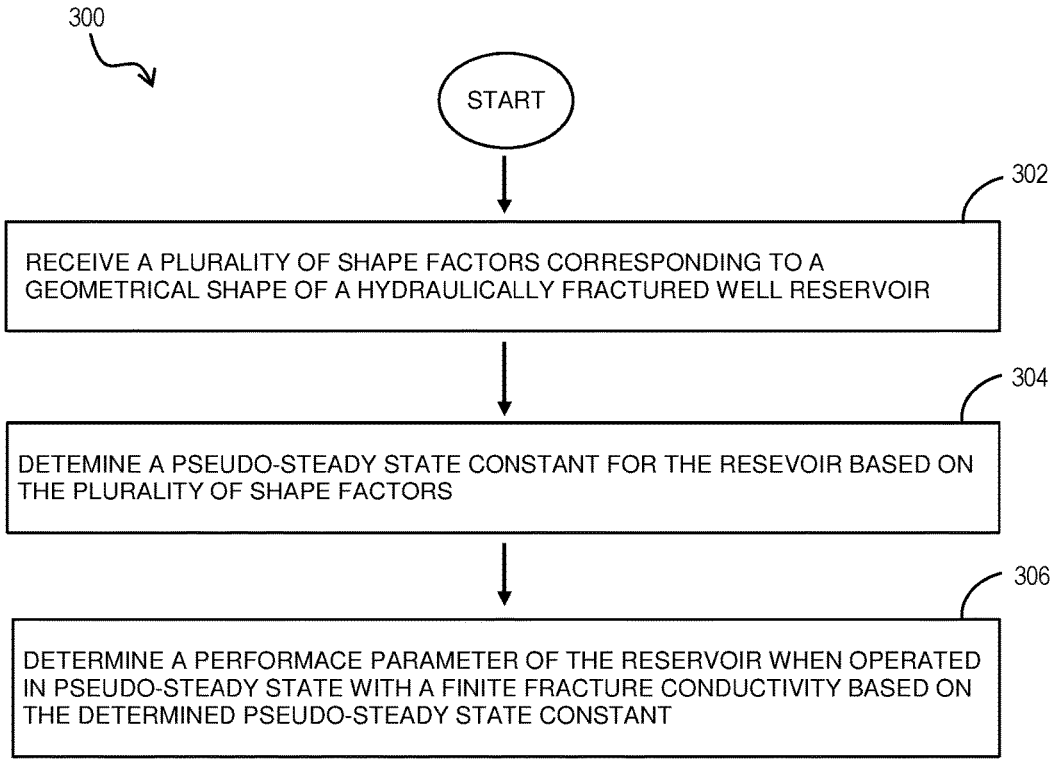
FIG. 3 is a flow chart illustrating an example method for computing an analytical solution for pseudo-steady state flow for a vertically fractured well with finite fracture conductivity in a closed reservoir according to some embodiments of the disclosure.

FIG. 3 is a flow chart illustrating an example method for computing an analytical solution for pseudo-steady state flow for a vertically fractured well with finite fracture conductivity in a closed reservoir according to some embodiments of the disclosure. A method 300 may begin at block 302 with receiving one or more shape factors corresponding to a geometrical shape of a hydraulically fractured well reservoir. The data received at block 302 may be received through, for example, an input device or local storage coupled to a processor or may be received through a network communication from a remote data store or remote input device. Examples of the one or more shape factors include ellipse focal distance/fracture half-length, formation thickness, dimensionless elliptical fracture conductivity, wellbore radius, radius of circular drainage boundary, reservoir volume, fracture width at the wellbore, elliptical coordinates, elliptical fracture shape, and elliptical reservoir shape.

Then, at block 304, a pseudo-steady state constant may be determined by the processor, such as using equation (41) for the reservoir based on the plurality of shape factors. The determination at block 304 may be performed using one or more elementary functions to obtain an analytical solution and/or without solving Mathieu functions, which can significantly improve the computational speed of the determination in comparison to prior art numerical simulations. Block 304 may alternatively or additionally include a computation of reservoir pressure drawdown from, for example, equation (38).

Next, at block 306, one or more performance parameters of the reservoir may be determined by the processor when the reservoir is operated in a pseudo-steady state with a finite fracture conductivity based on the determined pseudo-steady state constant. Although block 306 describes finite fracture conductivity, infinite fracture conductivity may alternatively be used for determining the performance parameter. Examples of performance parameters include a production decline rate for a reservoir, a total hydrocarbon reserves for a reservoir, an economically-recoverable reserves for a reservoir, the productivity index (PI), and the dimensionless productivity index ($J_D$). Using the performance parameters, decisions as to explore and produce from certain reservoirs may be made, and the improved information available from the pseudo-steady state analysis of the method 300 may increase profitability of the production from selected reservoirs. The one or more performance parameters or the pseudo-steady state constant may be stored in local or remote storage, output to a display screen, or communicated to another device through a network communications connection. Additional computations or decisions may be performed using the performance parameter, such as decisions relating to the production of hydrocarbons from a particular reservoir.

The specific features of the method 300 for determining a pseudo-steady state constant and a performance parameter from that constant results in a specific process for evaluating reservoirs using particular information and techniques. Analysis of reservoirs using the method 300 results in a technological improvement over the prior art numerical solutions, which are tedious simulations to process. The method 300 thus describes a process specifically designed to achieve an improved technological result of decreased computational time and increased computational accuracy in the conventional industry practice of determining performance from reservoirs. Furthermore, the method 300, and particularly block 304, describes a new analytical solution for calculation of parameters related to a reservoir that differs from conventional industry solutions.

Figure 4:
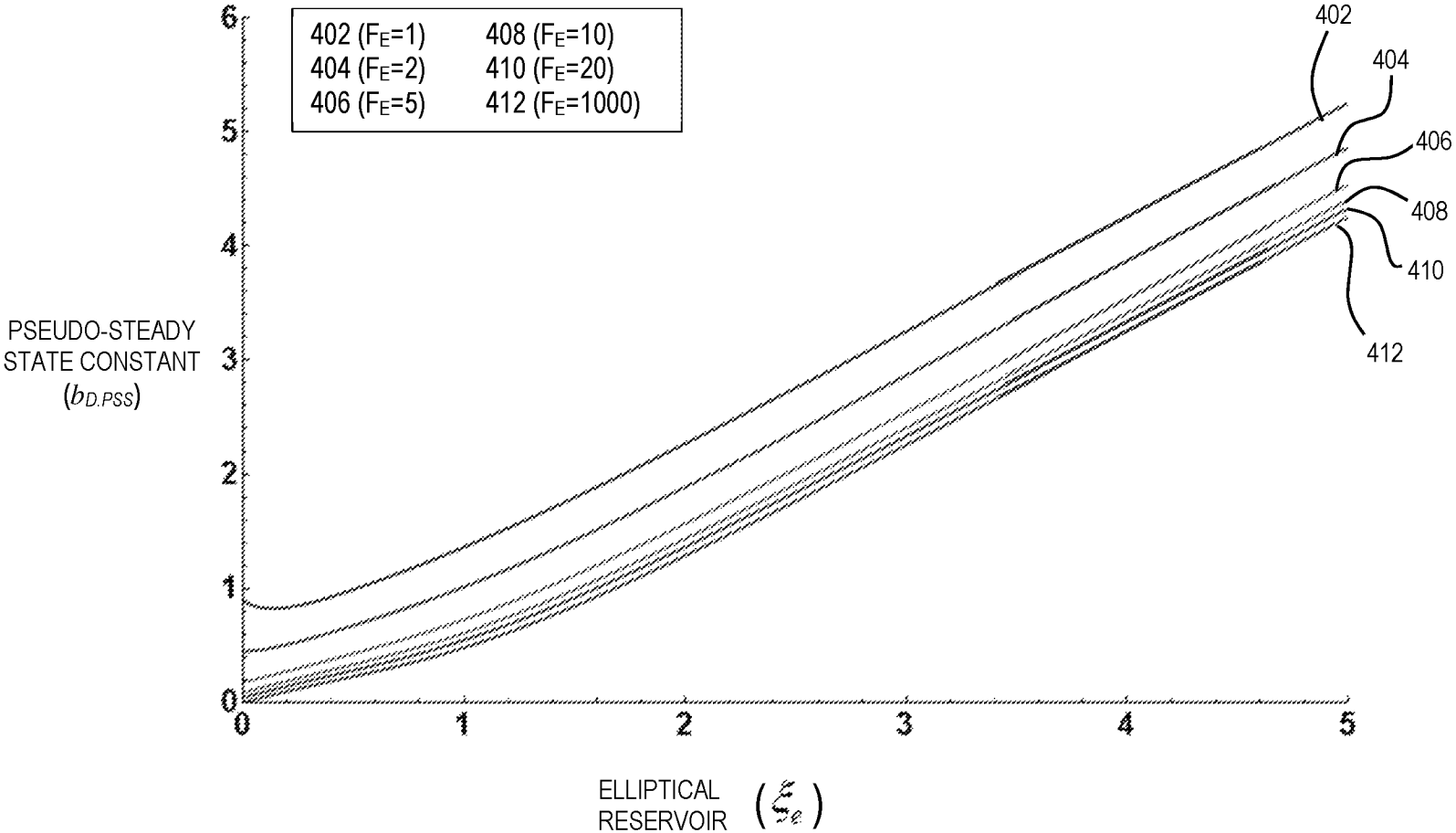
FIG. 4 are graphs of a pseudo-steady state constant computation as a function of $\xi_e$ calculated according to some embodiments of the disclosure.

FIG. 4 are graphs of a pseudo-steady state constant computation as a function of $\xi_e$ calculated according to some embodiments of the disclosure. The pseudo-steady state constant $b_{D,PSS}(\xi_e,F_E)$ is plotted against $\xi_e$ for $F_E$=1, 2, 5, 10, 20, 1000 in lines 402, 404, 406, 408, 410, and 412 of FIG. 4, respectively. It is observed that for large $\xi_e$, the slope $\partial b_{D,PSS}/\partial \xi_e$ becomes one, regardless of the value of the fracture conductivity $F_E$.

Comparison with Existing Results

The analytical solution obtained in the present work is exact and general under the assumptions adopted, and the solution is valid for both infinite and finite fracture conductivities. A comparison between this new analytical solution and presently known results is provided below.

Infinite Fracture Conductivity.

One conventional pseudo-steady state solution for the case of infinite fracture conductivity, $F_E \rightarrow \infty$ shows that the dimensionless pressure drawdown in the reservoir:

$$\Delta p_{D,Prats} = 2t_{D,Prat} + \xi_e + \frac{1}{2\sinh 2\xi_e} - \frac{3}{4}\coth 2\xi_e - \frac{1}{2\sinh 4\xi_e} - \xi - \frac{1}{\sinh 4\xi_e}\cosh 2(\xi_e - \xi)\cos 2\eta + \frac{\cosh 2\xi + \cos 2\eta}{2\sinh 2\xi_e}, \tag{43}$$

where dimensionless time $t_{D,Prat}$ is defined as related to $t_{DA}$ by (after a correction to a missing factor $\phi$ in their definition):

$$t_{D,Prats} = \frac{\pi\kappa t}{\mu\phi c_t A} = \pi t_{DA}. \tag{44}$$

Thus, the dimensionless reservoir pressure drawdown from is:

$$\Delta p_{D,Prats} = 2\pi t_{DA} + \xi_e + \frac{1}{2\sinh 2\xi_e} - \frac{3}{4}\coth 2\xi_e - \frac{1}{2\sinh 4\xi_e} - \xi - \frac{\cosh 2(\xi_e - \xi)\cos 2\eta}{\sinh 4\xi_e} + \frac{\cosh 2\xi + \cos 2\eta}{2\sinh 2\xi_e}. \tag{45}$$

From equation (38), for infinite fracture conductivity, $F_E \rightarrow \infty$, the infinite sum becomes zero, and $$a_1 = -\frac{1}{8}\frac{1}{\cosh 2\xi_e}.$$

Thus, the reservoir dimensionless pressure drawdown becomes $$\Delta p_{D,PSS}(\xi, \eta, t_{DL}) = 2\pi t_{DA} + \xi_e - \xi + + \frac{1}{\sinh 2\xi_e}\left[-\frac{3\cosh 2\xi_e - 2}{4} - \frac{1}{4}\frac{1}{\cosh 2\xi_e} - \frac{1}{2}\frac{1}{\cosh 2\xi_e}\cos 2\eta\cosh 2(\xi_e - \xi) + \frac{\cosh 2\xi + \cos 2\eta}{2}\right],$$

which is identical to the prior art result of equation (45).

Similarly, the pressure drawdown at the well from our solution becomes $$\Delta p_{D,PSS} 2\pi t_{DA} + \xi_e - \frac{(3\cosh 2\xi - 1)(\cosh 2\xi - 1)}{4\sinh 2\xi_e \cosh 2\xi_e}, \tag{46}$$

which gives the pseudo-steady state constant for the case of infinite fracture conductivity $$b_{D,PSS} = \xi_e - \frac{(3\cosh 2\xi_e - 1)(\cosh 2\xi_e - 1)}{4\sinh 2\xi_e \cosh 2\xi_e}. \tag{47}$$

In summary, in the limit of infinite fracture conductivity, an analytical solution according to embodiments described herein matches a conventional solution for infinite fracture conductivity. This demonstrates that the analytical model is correct, and that at least one specific calculation matches a result from a conventional model.

Finite Fracture Conductivity.

For finite fracture conductivity, the pseudo-steady state constant also depends on the dimensionless fracture conductivity $F_E$: $b_{D,PSS}=b_{D,PSS}(\xi_e,F_E)$. $b_{D,PSS}(\xi_e,F_E)$ has been computed in the prior art for selected sets of $\xi_e,F_E$ by subtracting $2\pi t_{DA}$ from numerical simulation results for large times. This procedure involves numerical manipulation of the Mathieu functions in the Laplace transform space as well as numerical inversion; and it is tedious and time-consuming, as noted by these authors. A nonlinear-regression may be applied to fit such numerical results into an empirical formula for $b_{D,PSS}(\xi_e,F_E)$ $$b_{D,PSS}(\xi_e, F_E) = 1.00146\xi_e + 0.0794849e^{-\xi_e} - 0.16703u + \frac{A}{B} - 0.754772, \quad (48)$$

with $$u=\ln F_E,$$

$$A=a_1+a_2u+a_3u^2+a_4u^3+a_5u^4, B=b_1+b_2u+b_3u^2+b_4u^3+b_5u^4,$$

$$a_1=-4.7468, b_1=-2.4941,$$

$$a_2=36.2492, b_2=21.6755,$$

$$a_3=55.0998, b_3=41.0303,$$

$$a_4=-3.98311, b_4=-10.4793,$$

$$a_5=6.07102, b_5=5.6108.$$

However, there are some apparent inconsistency and problematic issues with equation (48): (i) the formula cannot re-produce certain tabulated results of the prior art; (ii) equation (48) can give rise to negative values of $b_{D,PSS}$ when $F_E$ becomes large; and it does not converge to the exact result of the prior art for infinite fracture conductivity; (iii) when the empirical equation (48) is compared to the disclosed analytical solution for $b_{D,PSS}(\xi_e,F_E)$ in equation (41), it is immediately obvious that the coefficient for the linear term $\xi_e$ in equation (48) must be "1.0", instead of "1.00146."

The results of the analytical solution of equation (41) are computed and compared to corresponding values $b_{D,PSS}(\xi_e, F_E)$ for the parameter sets as known in the prior art. The results are shown below in our Table 1, where the results of prior art are listed in the parentheses for comparison. It is seen that the numerically computed values from the prior art generally agree very well with the described analytical solution.

TABLE 1

Values of $b_{D,PSS}(\xi_e,F_E)$ from the analytical solution. Values in the parentheses are those of prior art numerical simulations.

| $\xi_e$ | $F_E$ = 1 | $F_E$ = 10 | $F_E$ = 100 | $F_E$ = 1000 |
|---|---|---|---|---|
| 0.25 | 0.849411 (0.8481) | 0.213087 (0.2150) | 0.130127 (0.1306) | 0.121565 (0.1220) |
| 0.50 | 0.989853 (0.9902) | 0.333336 (0.3337) | 0.239246 (0.2396) | 0.229383 (0.2298) |
| 0.75 | 1.16694 (1.1671) | 0.460557 (0.4609) | 0.353713 (0.3540) | 0.342402 (0.3426) |
| 1.00 | 1.3632 (1.3627) | 0.610541 (0.6109) | 0.493289 (0.4936) | 0.480809 (0.4812) |
| 1.25 | 1.57305 (1.5733) | 0.787704 (0.7880) | 0.663153 (0.6634) | 0.649857 (0.6501) |
| 1.50 | 1.79635 (1.7963) | 0.988308 (0.9884) | 0.858987 (0.8591) | 0.845162 (0.8453) |
| 1.75 | 2.02893 (2.0293) | 1.20624 (1.2067) | 1.07391 (1.0743) | 1.05975 (1.0602) |
| 2.00 | 2.26787 (2.2682) | 1.43597 (1.4363) | 1.30178 (1.3021) | 1.28741 (1.2877) |
| 3.00 | 3.25252 (3.2529) | 2.40795 (2.4084) | 2.27122 (2.2716) | 2.25658 (2.2570) |
| 4.00 | 4.25038 (4.2503) | 3.40407 (3.4040) | 3.26699 (3.2669) | 3.25231 (3.2522) |
| 5.00 | 5.25009 (5.2486) | 4.40354 (4.4021) | 4.26642 (4.2649) | 4.25173 (4.2502) |

Discussions

Analytical solutions for the reservoir pressure drawdown $\Delta p_{D,PSS}$ and the pseudo-steady state constant $b_{D,PSS}$ are given by equations (38) and (41), respectively. These expressions may be exact for fully-penetrating hydraulically fractured vertical wells producing from a closed reservoir approximated as having an elliptical shape, and the solutions are valid for both finite and infinite fracture conductivities. As a result of the analytical solution described in embodiments of the disclosure herein, tedious and time consuming numerical simulations for obtaining pseudo-steady state solutions for fractured wells are no longer necessary for such reservoirs. For a fractured-well in a large circular reservoir with a radius R, these formulas can be readily applied with $\xi_e=\ln(2R/L)$, because a large circle and an ellipse with large $\xi_e$ are nearly identical. It is also possible to extend the expression for the pseudo-steady state constant $b_{D,PSS}$ to a fractured-well in reservoirs of different geometrical shapes using an equivalent elliptical parameter $\xi_e$ based on the reservoir drainage area or shape factors.

Conclusions

An exact analytical solution for pseudo-steady state productive flow from a fully-penetrating hydraulically fractured vertical well with finite fracture conductivity in a closed reservoir approximated as having an elliptical shape is rigorously derived. The solution agrees with prior art solutions in the limit of infinite fracture conductivity, and it agrees with the numerical results of the prior art for finite fracture conductivity. The analytical solution is exact, general and expressed in terms of elementary functions; it is simple and easy to evaluate; and it completely eliminates the need of performing numerical simulation for obtaining pseudo-steady state solution for a vertically fractured well in such a reservoir. Simple expressions for the pseudo-steady state constant and the dimensionless productivity index are described above. The solution may also be used to generate approximate analytical solutions for pseudo-steady state flow from a fractured-well in reservoirs of different geometrical shapes.

Advantages of Embodiments of the Invention

An exact analytical solution in the physical variable space for pseudo-steady state production from a vertically fractured well with finite fracture conductivity in an elliptical reservoir is obtained from this work. The solution is expressed in terms of elementary functions and it yields a simple, exact expression for the pseudo-steady state constant $b_{D,PSS}$ and the dimensionless productivity index $J_{D,PSS}$. This is the first time that an exact analytical solution has been obtained for pseudo-steady state flow for a fractured well with finite conductivity.

Some advantages resulting from this analytical solution are listed below:

(1) It eliminates the need to perform time-consuming numerical simulation in order to obtain the pseudo-steady state constant $b_{D,PSS}$ $b_{D,PSS}$ and the dimensionless productivity index $J_{D,PSS}$ for fractured wells in elliptical reservoirs, and it shortens the required computing time from hours/days to seconds;

(2) By introducing suitable shape factors, the solution can be used to obtain approximate expressions for the pseudo-steady state constant $b_{D,PSS}$ for fractured wells in reservoirs of other geometrical shapes;

(3) The solution can be readily adopted for use with production decline models and simulators for estimating total hydrocarbon reserves in-place as well as economically recoverable reserves;

(4) The solution can be used for optimal fracture design so that the production is optimized;

(5) The solution can be used as a benchmark to measure the accuracy of various numerical simulators; and (6) The techniques used in certain embodiments of the disclosure (such as hyperbolic functions and Fourier series expansions) circumvent the cumbersome Mathieu functions commonly used in studying production from fractured wells, and these techniques can be adopted for much wider use in studying similar problems.

Important of Pseudo Steady-State Flow Analysis

The duration of the pseudo-steady state flow and its productive performance largely determines the cumulative production of hydrocarbon form a well. The duration of pseudo-steady state flow is determined by how fast the bottom-hole flowing pressure decreases to the lowest permissible well pressure (critical pressure). Thus it is paramount to know the change of the wellbore pressure with time. The pressure drawdown (pressure drop from the initial reservoir pressure) at the wellbore is commonly expressed in dimensionless form as $$\Delta p_{wD,PSS}=2\pi t_{DA}+b_{D,PSS}, \tag{49}$$

where $t_{DA}$ is the drainage area based dimensionless time, and $b_{D,PSS}$ is the so-called pseudo-steady state constant which depends on the reservoir model as well as the well/reservoir configuration. Thus, two parameters determine the duration of the pseudo-steady state flow period: the time-rate of decline, which is determined by the production rate, and the pseudo-steady state constant.

The productive performance of a well is measured by the productivity index, J, which is the amount of hydrocarbon produced per unit drop in the reservoir average pressure. For pseudo-steady state flow, the productivity index is inversely proportional to the pseudo-steady state constant $b_{D,PSS}$, $$J=\frac{\kappa h}{\mu}\frac{2\pi}{b_{D,PSS}}, \tag{50}$$

where κ,μ,h are the reservoir permeability, hydrocarbon viscosity, and hydrocarbon bearing formation thickness, respectively. Thus, the productivity of a well during the pseudo-steady state period is completely determined by the pseudo-steady state constant $b_{D,PSS}$.

Figure 1:
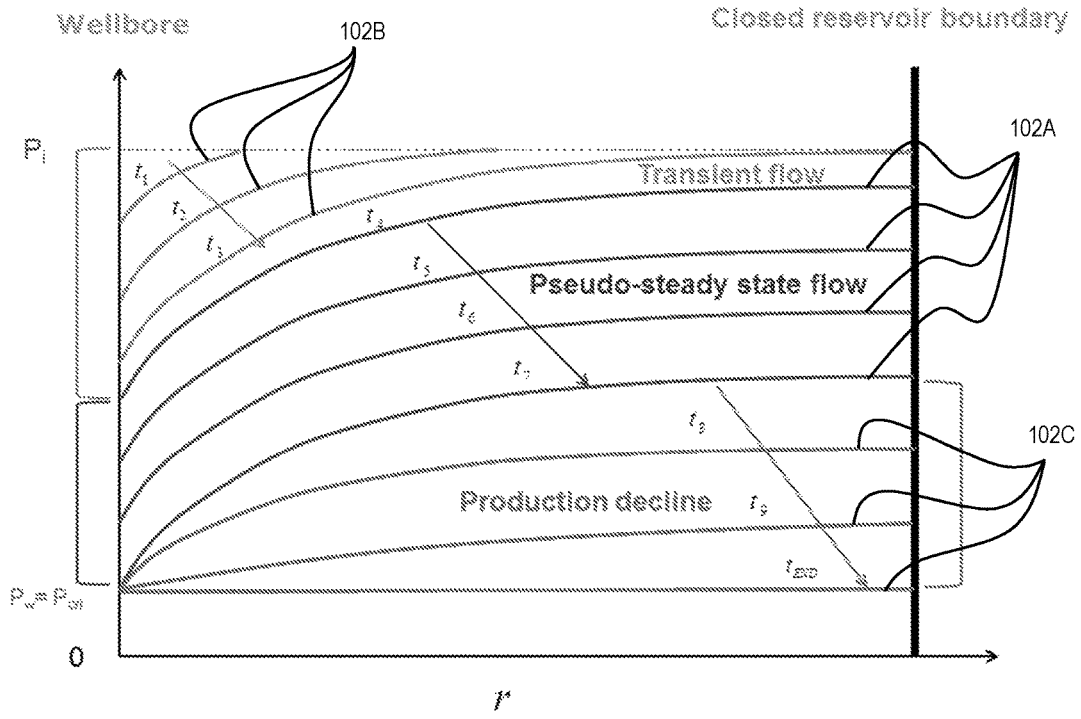
FIG. 1 (Prior Art)
FIG. 1 are graphs illustrating reservoir pressure change with time for a well producing at constant rate in a closed reservoir according to the prior art.

Furthermore, pseudo-steady state solution has been often used in the production rate decline analysis because pseudo-steady state is the flow regime immediate preceding the production rate decline period (as shown in FIG. 1). Production rate decline can be used for estimating the hydrocarbon reserves in place and for assessing the economically recoverable amount of hydrocarbon from a reservoir.

The pseudo-steady state flow analysis can be used to improve production from reservoirs, because: Pseudo-steady state flow can impact the cumulative production of hydrocarbon from a well; the productive performance of a well can be assessed by evaluating the productivity of the well during the pseudo-steady state flow, which is determined by the value of the pseudo-steady state constant $b_{D,PSS}$; Pseudo-steady state flow can be used for estimating the total reserves in place in a reservoir; and Pseudo-steady state flow can be used for estimating the economically recoverable amount of hydrocarbon from a reservoir.

Implementation

Computations described in the embodiments above may be executed on any suitable processor-based device including, without limitation, personal data assistants (PDAs), tablet computers, smartphones, computer game consoles, and multi-processor servers. Moreover, the systems and methods of the present disclosure may be implemented on application specific integrated circuits (ASIC), very large scale integrated (VLSI) circuits, or other circuitry.

If implemented in firmware and/or software, the functions described above may be stored as one or more instructions or code on a computer-readable medium. Examples include non-transitory computer-readable media encoded with a data structure and computer-readable media encoded with a computer program. Computer-readable media includes physical computer storage media. A storage medium may be any available medium that can be accessed by a computer. By way of example, and not limitation, such computer-readable media can comprise RAM, ROM, EEPROM, CD-ROM or other optical disk storage, magnetic disk storage or other magnetic storage devices, or any other medium that can be used to store desired program code in the form of instructions or data structures and that can be accessed by a computer. Disk and disc includes compact discs (CD), laser discs, optical discs, digital versatile discs (DVD), floppy disks and blu-ray discs. Generally, disks reproduce data magnetically, and discs reproduce data optically. Combinations of the above should also be included within the scope of computer-readable media.

In addition to storage on computer readable medium, instructions and/or data may be provided as signals on transmission media included in a communication apparatus. For example, a communication apparatus may include a transceiver having signals indicative of instructions and data. The instructions and data are configured to cause one or more processors to implement the functions outlined in the claims.

Although the present disclosure and its advantages have been described in detail, it should be understood that various changes, substitutions and alterations can be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the present invention, disclosure, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

What is claimed is:

1. A method for increasing production of hydrocarbon from a hydraulically fractured well reservoir, the method comprising:

receiving over an electronic network, from a remote input device and at a processor configured for determining parameters of hydrocarbon production for the hydraulically fractured well reservoir, a plurality of shape factors corresponding to a geometrical shape of a hydraulically fractured well reservoir;

determining, by the processor, a pseudo-steady state constant for the reservoir based, at least in part, on an analytical solution involving the plurality of shape factors;

determining, by the processor, a performance parameter of the reservoir when operated in a pseudo-steady state based on the determined pseudo-steady state constant; and selecting, based on the performance parameter, the reservoir for increasing production of hydrocarbon, wherein the pseudo-steady state constant is determined, by the processor, according to the following equation:

$$b_{D,PSS} = \xi_e + \frac{1}{\sinh 2\xi_e} - \frac{3}{4}\coth 2\xi_e + \frac{2a_1}{\sinh 2\xi_e} + \frac{1}{F_E}\left[\frac{\pi^2}{6} + 4a_1 - \sum_{n=2}^{\infty}\frac{1}{n^2}\frac{1}{1+nF_E\coth 2n\xi_e}\right].$$

2. The method of claim 1, further comprising ceasing production of hydrocarbons from the reservoir based on the performance parameter.

3. The method of claim 1, wherein the step of determining the pseudo-steady state constant is performed without solving Mathieu functions.

4. The method of claim 1, wherein the step of determining the performance parameter comprises determining total hydrocarbon reserves for the reservoir.

5. The method of claim 1, wherein the shape factors comprise one or more of ellipse focal distance, fracture half-length, formation thickness, dimensionless elliptical fracture conductivity, wellbore radius, radius of circular drainage boundary, reservoir volume, fracture width at the wellbore, elliptical coordinates, elliptical fracture shape, or elliptical reservoir shape.

6. The method of claim 1, wherein the determining the performance parameter comprises determining a production decline rate for the reservoir.

7. The method of claim 1, wherein the determining the performance parameter comprises determining economically recoverable reserves for the reservoir.

8. The method of claim 1, wherein a wellhead is coupled to a hydraulically fractured vertical well that fully penetrates the reservoir.

9. A method for increasing a increasing production of hydrocarbon from a hydraulically fractured well reservoir, the method comprising:

receiving over an electronic network, from a remote input device and at a processor configured for determining parameters of hydrocarbon production for the hydraulically fractured well reservoir, a plurality of shape factors corresponding to a geometrical shape of a hydraulically fractured well reservoir;

determining, by the processor, a pseudo-steady state constant for the reservoir based, at least in part, on an analytical solution involving the plurality of shape factors;

determining, by the processor, a performance parameter of the reservoir when operated in a pseudo-steady state based on the determined pseudo-steady state constant; and assessing, based on the performance parameter, an economically recoverable amount of hydrocarbon from the reservoir, wherein the pseudo-steady state constant is determined, by the processor, according to the following equation:

$$b_{D,PSS} = \xi_e + \frac{1}{\sinh 2\xi_e} - \frac{3}{4}\coth 2\xi_e + \frac{2a_1}{\sinh 2\xi_e} + \frac{1}{F_E}\left[\frac{\pi^2}{6} + 4a_1 - \sum_{n=2}^{\infty}\frac{1}{n^2}\frac{1}{1+nF_E\coth 2n\xi_e}\right].$$

10. A method for increasing production of hydrocarbon from a hydraulically fractured well reservoir, the method comprising:

receiving over an electronic network, from a remote input device and at a processor configured for determining parameters of hydrocarbon production for the hydraulically fractured well reservoir, a plurality of shape factors corresponding to a geometrical shape of a hydraulically fractured well reservoir;

determining, by the processor, a pseudo-steady state constant for the reservoir based, at least in part, on an analytical solution involving the plurality of shape factors;

determining, by the processor, a performance parameter of the reservoir when operated in a pseudo-steady state based on the determined pseudo-steady state constant; and estimating, by the processor and based on the performance parameter, the hydrocarbon reserves of the reservoir, wherein the pseudo-steady state constant is determined, by the processor, according to the following equation:

$$b_{D,PSS} = \xi_e + \frac{1}{\sinh 2\xi_e} - \frac{3}{4}\coth 2\xi_e + \frac{2a_1}{\sinh 2\xi_e} + \frac{1}{F_E}\left[\frac{\pi^2}{6} + 4a_1 - \sum_{n=2}^{\infty}\frac{1}{n^2}\frac{1}{1+nF_E\coth 2n\xi_e}\right].$$

* * * * *